US006840826B2

(12) United States Patent
Fuse et al.

(10) Patent No.: US 6,840,826 B2
(45) Date of Patent: Jan. 11, 2005

(54) WATER JET PROPULSION APPARATUS

(75) Inventors: Tomohiro Fuse, Saitama (JP); Masahiko Tsuchiya, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/231,315

(22) Filed: Aug. 30, 2002

(65) Prior Publication Data

US 2003/0045183 A1 Mar. 6, 2003

(30) Foreign Application Priority Data

Sep. 6, 2001 (JP) ..... 2001-270154

(51) Int. Cl.[7] ..... B63H 11/103
(52) U.S. Cl. ..... 440/47; 416/245 A
(58) Field of Search ..... 440/38, 40, 47; 416/244 B, 245 A; 60/221, 222

(56) References Cited

U.S. PATENT DOCUMENTS 1,824,667 A * 9/1931 Grumpelt ..... 416/175
3,083,529 A * 4/1963 Hamilton ..... 60/221
3,811,397 A * 5/1974 Usborne ..... 440/47
4,541,808 A * 9/1985 Ono et al. ..... 440/42
5,277,631 A * 1/1994 Henmi ..... 440/47
5,759,074 A * 6/1998 Jones ..... 440/38
6,027,383 A * 2/2000 Broinowski ..... 440/38
6,253,696 B1 * 7/2001 Mashiko ..... 114/55.5
6,273,768 B1 * 8/2001 Blanchard ..... 440/38
6,273,769 B1 * 8/2001 Bell ..... 440/38

FOREIGN PATENT DOCUMENTS

JP 5-105189 A 4/1993

* cited by examiner

*Primary Examiner*—Andrew Wright
(74) *Attorney, Agent, or Firm*—Birch, Stewart, Kolasch & Birch, LLP

(57) ABSTRACT

A water jet propulsion apparatus having a duct forming a channel, an impeller disposed in the duct, a bearing of the impeller provided in the duct, and a cap closing the rear end of the bearing. In addition, at least one stream-straightening groove is formed in an external face of the cap. In the internal face of the duct, a stationary vane is formed in a portion facing toward the cap. Accordingly, a rotational component of a water stream close to the external face of a cap the bearing is substantially reduced, the size of the cap may be reduced, and cap position is not controlled by the position of the stationary vane.

18 Claims, 6 Drawing Sheets

WATER JET PROPULSION APPARATUS

CROSS-REFERENCES TO RELATED APPLICATIONS

This nonprovisional application claims priority under 35 U.S.C. § 119(a) on patent application Ser. No. 2001-270154 filed in Japan on Sep. 6, 2001, the entirety of which is herein incorporated by reference.

BACKGROUND OF THE INVENTION

1. Field of the Invention

The present invention relates to a water jet propulsion apparatus, and more particularly to a water jet propulsion apparatus for use in a watercraft.

2. Description of the Background Art

A water jet propulsion apparatus of the background art, e.g., corresponding to Japanese Patent Laid-open No. Hei-5-105189, the entirety of which is hereby incorporated by reference, is shown in FIG. 6. The water jet propulsion apparatus has a duct 2 forming a channel in communication with an intake 1*a* provided on the bottom of a hull 1, an impeller 3 disposed in the duct 2, a bearing 4 of the impeller provided in the duct 2, and a cap 5 closing the rear end of the bearing 4. The duct 2 includes an impeller duct 2*a*, a stationary vane duct 2*b*, and a nozzle 2*c*. The bearing 4 is formed integrally with the stationary vane duct 2*b* via a stationary vane 2*b*1.

The impeller 3 is fixed to a drive shaft 6. The front end of the drive shaft 6 is coupled to the output shaft of an engine (not-shown) mounted on the hull 1, and the rear end 6*a* is rotatably supported by the bearing 4. A stationary vane 5*a* is formed on the external face of the cap 5, and a stationary vane 2*c*1 is integrally formed on the internal face of the nozzle 2*c*. A deflector 7 is rotatably attached to the rear part of the nozzle 2*c*.

In such a water jet propulsion apparatus, when the impeller 3 is rotated by the rotation of the engine via the drive shaft 6, water drawn in from the intake 1*a* is passed through the impeller duct 2*a* and discharged from a jet port 2*c*2 of the nozzle 2*c* to the outside via the deflector 7 to propel the hull 1. The water flow is straightened by the stationary vanes 2*b*1 and 2*c*1 in a process of passing the flow through the stationary duct 2*b* and nozzle 2*c*.

In the above-described conventional water jet propulsion apparatus, since the stationary vane 5*a* is formed on the cap 5, the rotational component of a water stream near the center of the nozzle 2*c*, e.g., around the cap 5 the rotational component of the water stream can be reduced and the water stream can be straightened to a certain degree. However, it is difficult to form a number of stationary vanes 5*a* within the limited length of the outer circumference of the cap 5 whose diameter is relatively small.

Therefore, the present inventors have determined that the rotational component of a water stream very close to the external face of the cap 5 cannot be sufficiently reduced with the systems of the background art. Since the stationary vane 5*a* is formed on the external face of the cap 5, the cap 5, including the stationary vane 5*a*, is relatively large. In addition, the stationary vane 5*a* formed on the external face of the cap 5 and the stationary vane 2*c*1 formed on the internal face of the nozzle 2*c* have to be repositioned.

SUMMARY OF THE INVENTION

The present invention overcomes the shortcomings associated with the background art and achieves other advantages not realized by the background art.

An object of the invention is to provide a water jet propulsion apparatus that can solve the above identified problems and/or sufficiently reduce the rotational component of the water stream close to the external face of the cap.

An additional object of the present invention is to reduce the size of the cap while achieving the aforementioned objects.

An additional object of the present invention is to provide a cap that does not require positioning between the cap and other stationary vanes.

One or more of these and other objects are accomplished by a water jet propulsion apparatus comprising a duct forming a channel; an impeller being disposed within the duct; a bearing of the impeller provided in the duct, the bearing having a rear end and a front end; a cap closing the rear end of the bearing, the cap having an external face and a front portion; and at least one stream straightening groove being formed in the external face of the cap.

One or more of these and other objects are further accomplished by a method of reducing a rotational component of a flow stream exiting a water jet propulsion apparatus for a watercraft, the method comprising installing a cap closing a rear end of a bearing for an impeller within a duct, the cap having an external face and a front portion; and forming at least one flow stream straightening groove within the external face of the cap for reducing the rotational component of the flow stream.

The water jet propulsion apparatus including a duct forming a channel, an impeller disposed in the duct, a bearing of the impeller provided in the duct, a cap closing the rear end of the bearing, and stream straightening grooves formed in the external face of the cap provides a rotational component of a water stream close to the external face of the cap that is significantly reduced by the stream straightening grooves.

Moreover, since it is sufficient to form the stream straightening grooves, e.g., not a stream straightening plate (stationary vane) in the external face of the cap, a number of stream straightening grooves can be formed in the limited outer circumference length of the cap whose diameter is typically relatively small. Accordingly, the rotational component of the water stream close to the external face of the cap can be sufficiently reduced with the present invention. In addition, the size of the cap can be reduced. Since stream straightening grooves are formed in the external face of the cap it becomes unnecessary to position the cap with the other stationary vanes. Therefore, formation of the stream straightening grooves in the external face of the cap is particularly effective in the case where a stationary vane is formed facing toward the portion facing the cap, e.g., in the internal face of the duct.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 1:
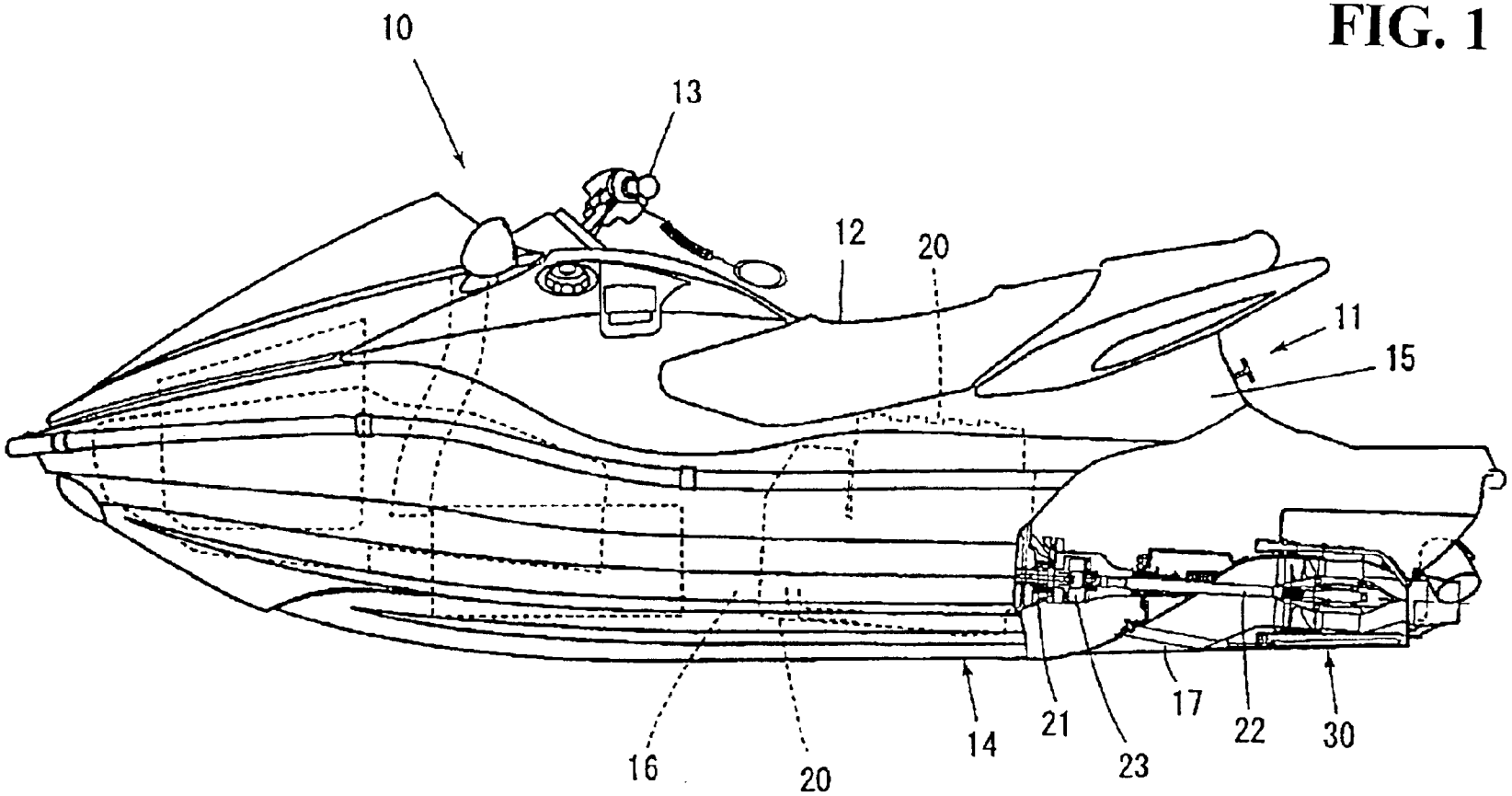
FIG. 1 is a partial, side view of a small, planing watercraft having a water jet propulsion apparatus according to an embodiment of the present invention.
Figure 2:
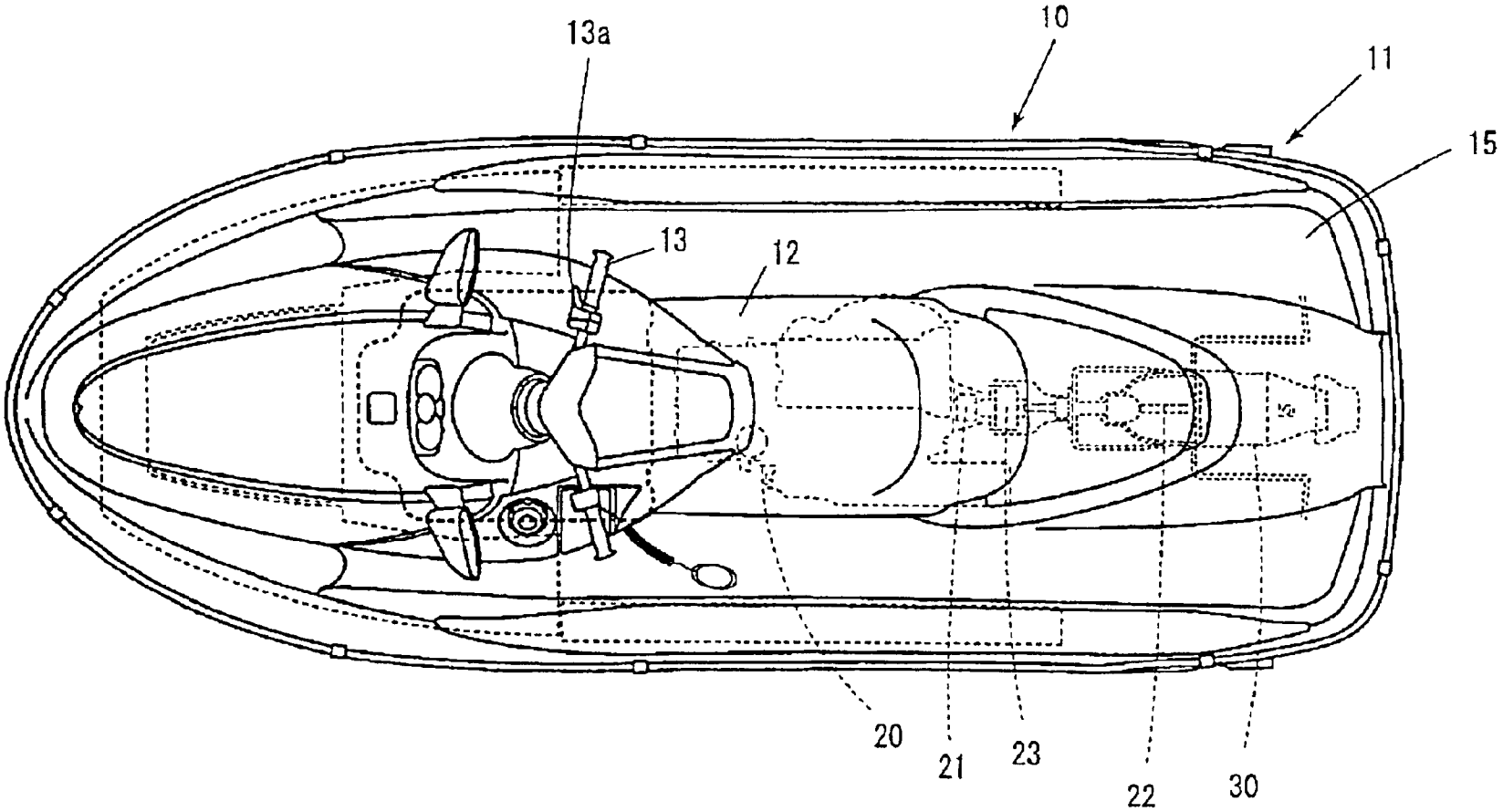
FIG. 2 is a plan view of the watercraft shown in FIG. 1.
Figure 3:
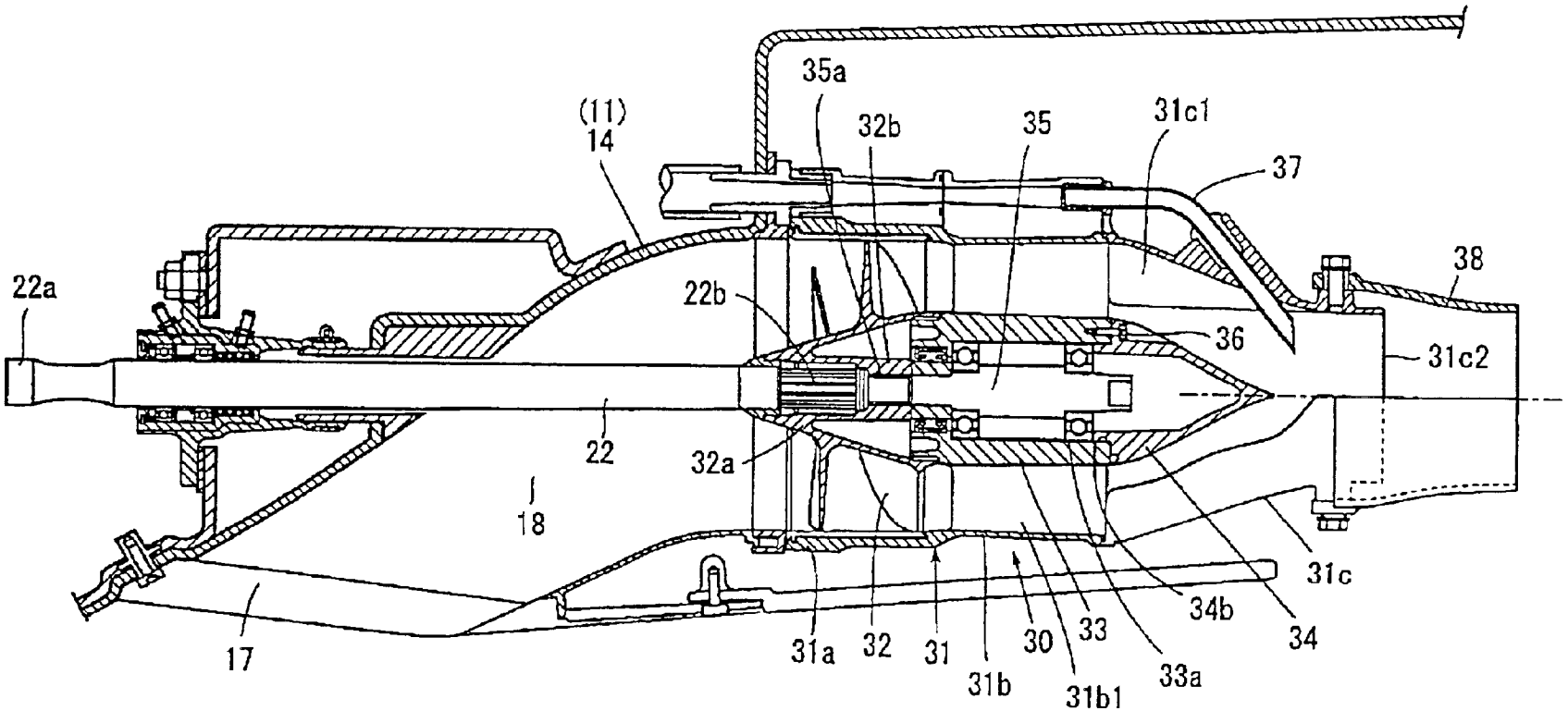
FIG. 3 is a sectional view showing a water jet propulsion apparatus according to the present invention.
Figure 4:
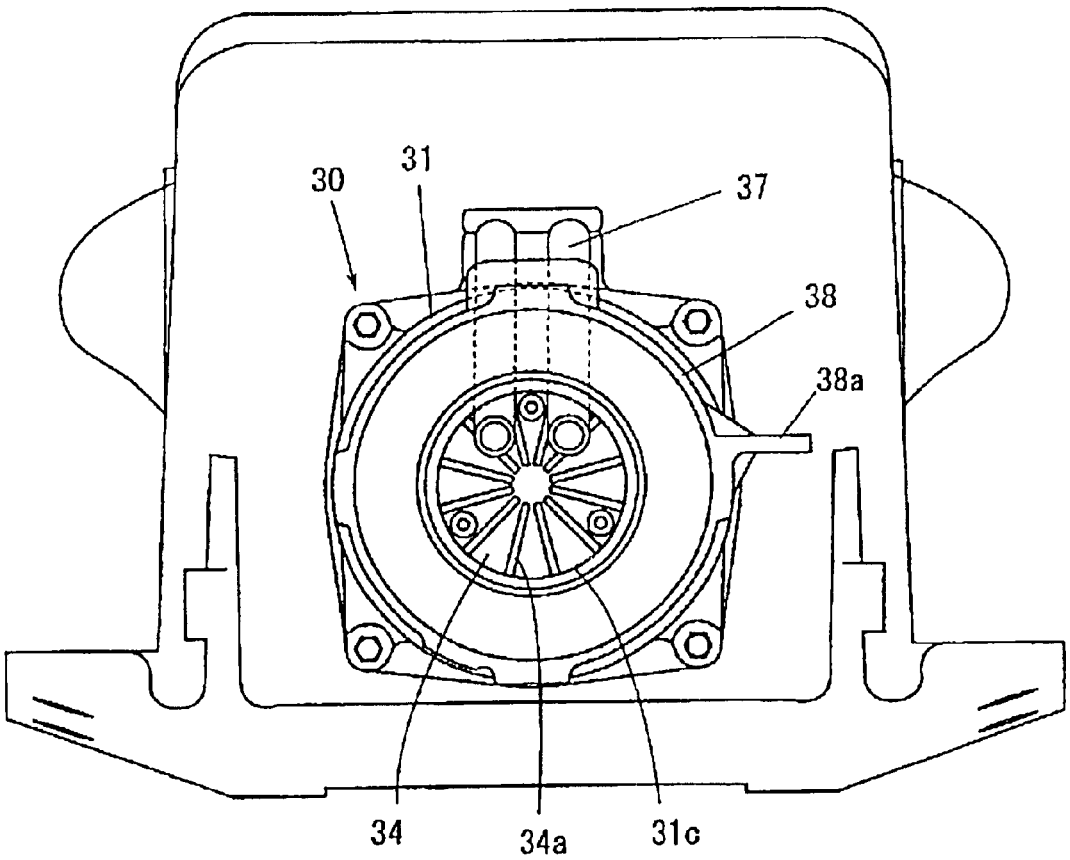
FIG. 4 is a rear view of the water jet propulsion apparatus according to the present invention.
Figure 5A:
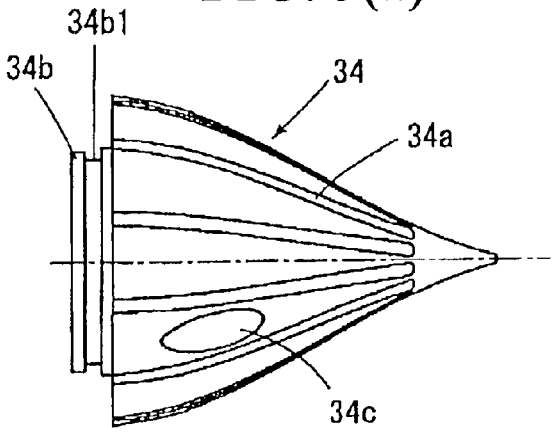
FIG. 5*a* is a side view of a cap according to the present invention.
Figure 5B:
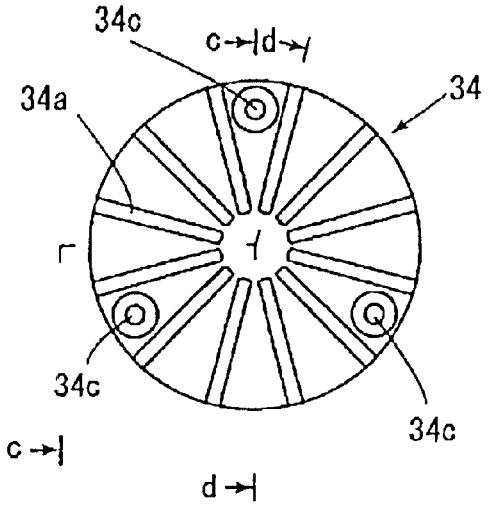
FIG. 5*b* is a right side view, when viewed from the rear of the watercraft body, of a cap according to the present invention.
Figure 5C:
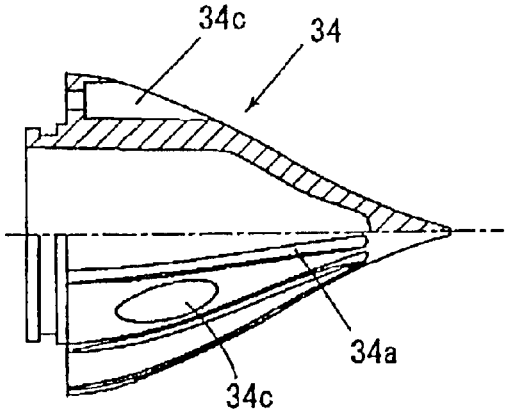
FIG. 5*c* a sectional view of a cap taken along line c—c of FIG. 5*b*.
Figure 5D:
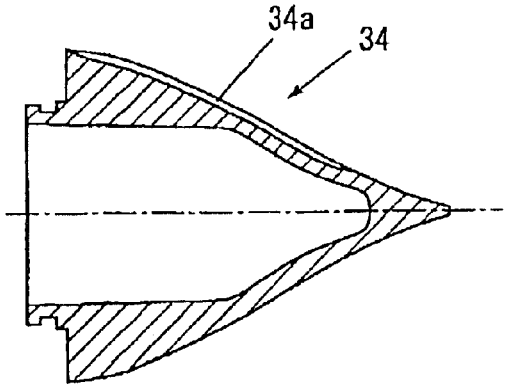
FIG. 5*d* is a cross section of a cap taken along line d—d of FIG. 5*b*.

The present invention will hereinafter be described with reference to the accompanying drawings. FIG. 1 is a partial, side view of a small, planing watercraft having a water jet propulsion apparatus according to an embodiment of the present invention. FIG. 2 is a plan view of the watercraft shown in FIG. 1. FIG. 3 is a sectional view showing a water jet propulsion apparatus according to the present invention. FIG. 4 is a rear view of the water jet propulsion apparatus according to the present invention. FIG. 5*a* is a side view of a cap according to the present invention. FIG. 5*b* is a right side view, when viewed from the rear of the watercraft body, of a cap according to the present invention. FIG. 5*c* a sectional view of a cap taken along line c—c of FIG. 5*b*. FIG. 5*d* is a cross section of a cap taken along line d—d of FIG. 5*b*.

As shown in FIGS. 1 and 2, a small planing watercraft 10 is a saddle-type small boat or watercraft. One of skill in the art will appreciate that the present invention is applicable to various types of watercraft, including, but not limited to, the type shown in FIGS. 1 and 2. An occupant sits on a seat 12 of a vessel body 11, and can drive the small planing craft 11 by gripping a steering handle 13 with a throttle lever. The vessel body 11 has a floating body structure obtained by bonding a hull 14 and a deck 15 and forming a space 16 on the inside therebetween. An engine 20 is mounted in the space 16 and on the hull 14, and a water jet propulsion apparatus or jet pump 30 as a propulsion device is driven by the engine 20 provided in the rear part of the hull 14.

As also shown in FIG. 3, the jet pump 30 has a duct 31 forming a channel 18 in communication with an intake 17 provided on the bottom of the vessel body 11. An impeller 32 is disposed in the duct 31, a bearing 33 of the impeller is provided in the duct 31, and a cap 34 for sealing the rear end of the bearing 33 is also provided in the jet pump assembly 30.

The duct 31 has an impeller housing part 31*a*, a bearing housing part 31*b*, and a nozzle part 31*c*. The impeller housing part 31*a* is integrally formed with the bearing housing part 31*b*. The bearing 33 is integrally formed in the bearing housing part 31*b* via a stationary blade 31*b*1. The front part of a boss 32*a* of the impeller 32 is engaged with a spline 22*b* formed in the rear end of a drive shaft so that the impeller 32 rotates with the drive shaft 22. The front end 22*a* of the drive shaft 22 is coupled to an output shaft 21 (refer to FIG. 1) of the engine 20 mounted on the vessel body 11 via a coupler 23.

A supporting shaft 35 supporting the rear part 32*b* of the boss 32*a* of the impeller 32 is rotatably supported by the bearing 33 via a ball bearing 33*a*. A male screw 35*a* is formed at the tip of the supporting shaft 35 and is screwed in a female screw portion formed in the rear part 32*b* of the boss 32*a* of the impeller 32, thereby coupling the impeller 32 and the supporting shaft 35. Therefore, the front part of the boss 32*a* of the impeller 32 is coupled to the drive shaft 22, the rear part 32*b* of the boss is coupled to the supporting shaft 35, and the impeller 32 rotates with the drive shaft 22 and the supporting shaft 35.

FIGS. 5*a*, 5*b*, 5*c*, and 5*d* are a side view, a right side view (seen from the rear of the vessel body), a cross section taken along line c—c of FIG. 5*b*, and a cross section taken along line d—d of FIG. 5*b*, respectively, of the cap 34. As seen in FIG. 5, a plurality of (twelve shown in FIG. 5) of stream straightening grooves 34*a* are formed in the external face of the cap 34. A cylindrical insertion portion 34*b* inserted to the rear part of the bearing 33 is formed in the front part of the cap 34, and three insertion holes 34*c* for screws 36 (refer to FIG. 3) are formed between the stream straightening grooves 34*a*. An attachment groove 34*b*1 for an O-ring (not shown) is formed in the cylindrical insertion part 34*b*.

An O-ring is attached to the cylindrical insertion part 34*b* and the insertion part 34*b* is inserted (force-fit) into the rear part of the bearing 33 as shown in FIG. 3, thereby attaching the cap 34 to the rear part of the bearing 33 by the screws 36. In the part facing the cap 34 in the internal face of the nozzle 31*c*, a stationary blade 31*c*1 is formed facing toward the cap 34. In the nozzle part 31*c*, a bilge pipe 37 is inserted on the bottom of the watercraft for draining bilge water.

A deflector 38 is rotatably attached to the rear part of the nozzle part 31*c*. In the jet pump 30 as described above, the impeller 32 is rotated by the rotation of the engine 20 via the drive shaft 22, and water drawn in from the intake 17 is jetted from a jet port 31*c*2 of the nozzle part 31*c* to the outside via the deflector 38. The flow stream is straightened by the stationary vanes 31*b*1 and 31*c*1 and the stream straightening grooves 34*a* of the cap 34 while the water stream passes through the duct 31. The water stream leaving the deflector 38 thereby propels the vessel body 11.

The number of revolutions of the engine 20, e.g., the propulsion generated by the jet pump 30 is controlled by an operation of turning a throttle lever 13*a* (refer to FIG. 2) of the steering handle 13. An arm 38*a* (refer to FIG. 4) of the deflector 38 is linked with the steering handle 13 via a control wire (not-shown) and is turned by the operation of the handle 13, thereby enabling changes in course of the watercraft 10.

Since the water jet propulsion apparatus 30 as described above has the duct 31 forming the channel, the impeller 32 disposed in the duct 31, the bearing 33 of the impeller 32 provided in the duct 31, the cap 34 closing the rear end of the bearing 33, and the stream straightening grooves 34*a* formed in the external face of the cap 34, the rotational component of the water stream close to the external face of the cap 34 can be reduced by the stream straightening grooves 34*a*.

Moreover, since it is sufficient to form the stream straightening grooves 34*a*, instead of a stream straightening plate, e.g., a stationary vane, in the external face of the cap 34, a number of relatively smaller stream straightening grooves 34*a* can be formed in the cap 34. For example, the grooves

34*a* may be cut into the limited outer circumferential length of the cap 34 whose diameter is relatively small. Thus, the rotational component of the water stream close to the external face of the cap 34 can be sufficiently reduced with the present invention.

Figure 6:
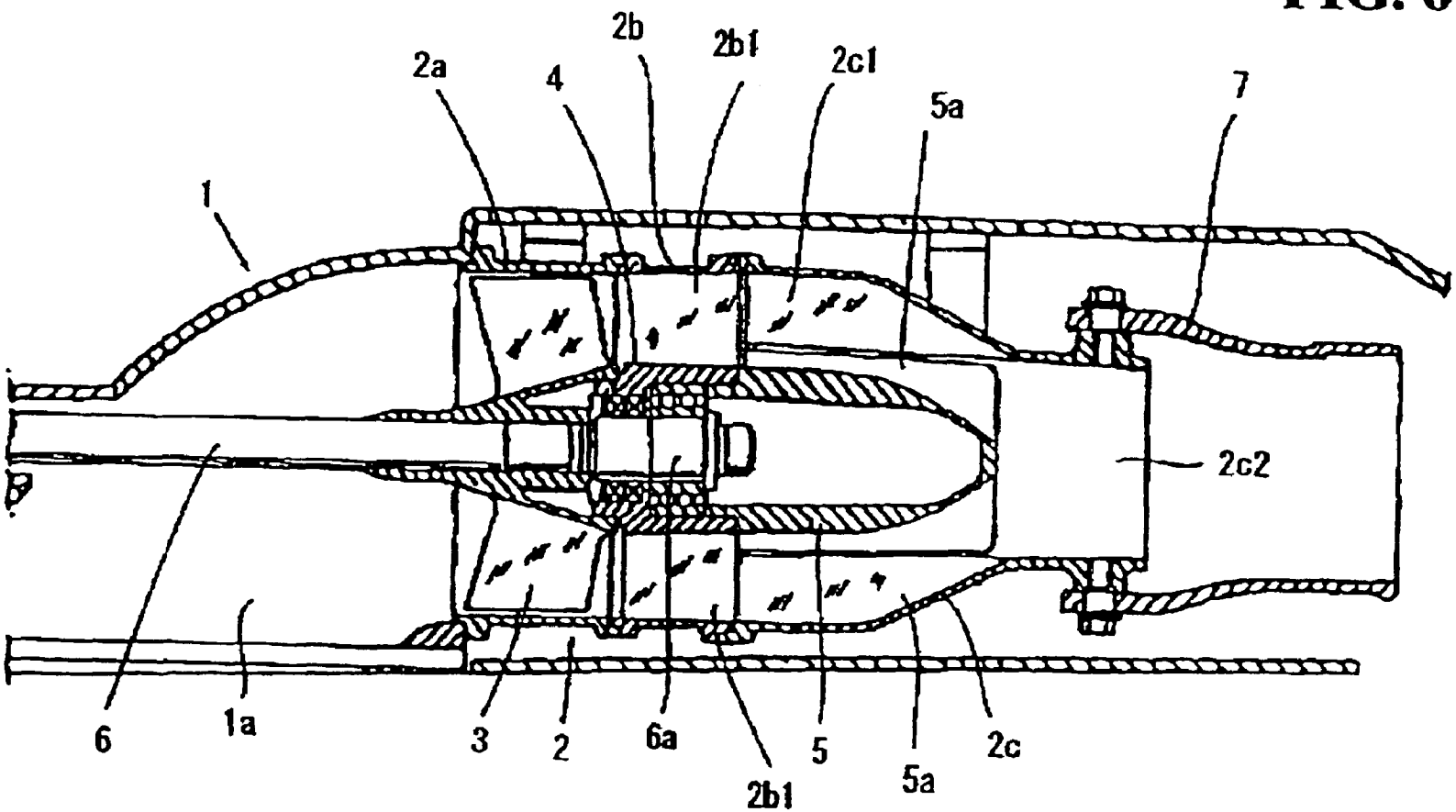
FIG. 6 Background Art
FIG. 6 is a sectional view of a propulsion apparatus of the background art.

Further, the size of the cap 34 can be advantageously reduced with the present invention. Further, since stream straightening grooves 34*a* are formed in the external face of the cap 34, it is unnecessary to position the cap 34 with the other stationary vanes 31*b*1 and 31*c*1. Therefore, the formation of stream straightening grooves 34*a* in the external face of the cap 34 is particularly effective in the case where the stationary vane 31*c*1 is formed facing toward the cap 34 in the internal face of the duct 31. Since the stream straightening grooves 34*a* are formed instead of a larger stationary vane or straightening plate (see FIG. 6), interference between the cap 34 and the bilge pipe 37 is also avoided with the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A water jet propulsion apparatus comprising:

a duct forming a channel;

an impeller being disposed within the duct;

a bearing of the impeller provided in said duct, said bearing having a rear end and a front end;

a cap closing the rear end of the bearing, said cap having an external face and a front portion;

a plurality of stream straightening grooves formed in the external face of the cap;

a plurality of fasteners; and a plurality of insertion holes being formed in the cap adjacent to and between respective stream straightening grooves, the insertion holes for accommodating said fasteners.

2. The water jet propulsion apparatus according to claim 1, further comprising a stationary vane being formed with an internal face of the duct and in a position facing toward said cap.

3. The water jet propulsion apparatus according to claim 2, wherein the duct includes an impeller housing portion, a bearing housing portion, and a nozzle portion, wherein the impeller housing portion is integrally formed with the bearing housing portion.

4. The water jet propulsion apparatus according to claim 3, wherein the bearing is integrally formed in a bearing housing portion with a stationary blade.

5. The water jet propulsion apparatus according to claim 4, further comprising:

a drive shaft;

a spline formed in a rear end of the drive shaft; and a boss for the impeller, said boss having a portion engaged with the spline formed in the rear end of the drive shaft.

6. The water jet propulsion apparatus according to claim 5, further comprising a cylindrical insertion portion being formed in the front portion of the cap, said cylindrical insertion portion operatively engaging the rear end of the bearing.

7. The water jet propulsion apparatus according to claim 6, further comprising a deflector rotatably engaged with the nozzle portion.

8. The water jet propulsion apparatus according to claim 1, wherein the duct includes an impeller housing portion, a bearing housing portion, and a nozzle portion, wherein the impeller housing portion is integrally formed with the bearing housing portion.

9. The water jet propulsion apparatus according to claim 8, wherein the bearing is integrally formed in a bearing housing portion with a stationary blade.

10. The water jet propulsion apparatus according to claim 8, further comprising a deflector rotatably engaged with the nozzle portion.

11. The water jet propulsion apparatus according to claim 1, further comprising:

a drive shaft;

a spline formed in a rear end of the drive shaft; and a boss for the impeller, said boss having a portion engaged with the spline formed in the rear end of the drive shaft.

12. The water jet propulsion apparatus according to claim 1, further comprising a cylindrical insertion portion being formed in the front portion of the cap, said cylindrical insertion portion operatively engaging the rear end of the bearing.

13. The water jet propulsion apparatus according to claim 12, further comprising an attachment groove for an O-ring formed within the cylindrical insertion part.

14. The water jet propulsion apparatus according to claim 1, further comprising a bilge pipe being inserted within a nozzle portion of the duct.

15. A method of reducing a rotational component of a flow stream exiting a water jet propulsion apparatus for a watercraft, said method comprising:

installing a cap closing a rear end of a bearing for an impeller within a duct, said cap having an external face and a front portion;

forming a plurality of flow stream straightening grooves in the external face of the cap for reducing the rotational component of the flow stream;

forming a plurality of fasteners; and a plurality of insertion holes being formed in the cap adjacent to and between respective flow stream grooves, the insertion holes for accommodating said fasteners.

16. The method according to claim 15, further comprising installing a plurality of the flow stream straightening grooves in the external face of the cap.

17. The method according to claim 16, wherein the watercraft is a personal, saddle-driven watercraft.

18. A water jet propulsion apparatus comprising:

a duct forming a channel;

an impeller being disposed within the duct;

a bearing of the impeller provided in said duct, said bearing having a rear end and a front end;

a cap closing the rear end of the bearing, said cap having an external face; and at least one flow stream straightening groove formed in the external face of the cap, the at least one flow stream straightening groove having a depth along a length thereof that is substantially constant and extending rearwardly to a position substantially opposite to a rear end of a hollow space in the cap.

* * * * *